United States Patent [19]

Mercurio

[11] 4,041,739

[45] Aug. 16, 1977

[54] MULTIPLE AXIAL PIN TUMBLER LOCK

[76] Inventor: Leonard Mercurio, 34 Beaumont Drive, Plainview, N.Y. 11803

[21] Appl. No.: 741,892

[22] Filed: Nov. 15, 1976

[51] Int. Cl.[2] ..... E05B 27/08

[52] U.S. Cl. ..... 70/363; 70/419

[58] Field of Search ..... 70/363, 419, 421, 378

[56] References Cited

U.S. PATENT DOCUMENTS

| | | | |
|---|---|---|---|
| 1,619,252 | 3/1927 | George | 70/363 |
| 3,045,468 | 7/1962 | Welch | 70/421 |
| 3,163,034 | 12/1964 | George | 70/419 |
| 3,783,660 | 1/1974 | Gill | 70/363 |
| 3,903,720 | 9/1975 | Scherbing | 70/363 |

*Primary Examiner*—Robert L. Wolfe
*Attorney, Agent, or Firm*—Charles E. Temko

[57] ABSTRACT

A linearly arranged tumbler type lock construction having secondary locking means brought into operation upon an attempt to pick the lock without a key. The tumblers include portions having annular grooves extending into the surfaces thereof at spaced intervals, selectively engageable with edges of apertures in a plate disposed between a movable cylinder element and a fixed cylinder element, whereby upon applying a torque to the movable cylinder element, the grooved portions of at least some of the tumbers engage the plate which is fixed against rotation thereby preventing further axial movement of the tumblers.

2 Claims, 4 Drawing Figures

MULTIPLE AXIAL PIN TUMBLER LOCK

BACKGROUND OF THE INVENTION

This invention relates generally to the field of locks of the so-called multiple axial pin tumbler type, commonly referred to in the art as an "ace type" lock, having means for preventing axial movement of the tumbler pins when an attempt is made to pick the lock by a process known as "torquing". A typical example of this type of lock is disclosed in U.S. Pat. No. 3,681,955 granted Aug. 18, 1972 to Ronald F. Sturgens. The construction includes a housing containing relatively fixed and movable cylinders, each containing portions of the usual split pins or tumblers. The tumbles are provided with grooves which are engaged by restricted portions of the bores in the fixed cylinder in which they are slidably disposed when an attempt is made to pick the lock, thus preventing further movement necessary to find the parting lines of each tumbler and align it with the plane of abutment of the relatively fixed and movable cylinders. While the construction disclosed in the above mentioned patent is quite effective, at least one of the fixed and movable cylinders must be provided with a plurality of bores of given diameter and counterbores of lesser diameter, a complicated machining operation tending to increase the cost of production. This structure is required in a part of the lock which is not readily manufactured by die casting techniques, and owing to the usual small size of the fixed cylinder, machining operations are not easily performed.

SUMMARY OF THE INVENTION

Briefly stated, the invention contemplates the provision of a lock of the above disclosed type, in which the constrictions in the bores of the fixed cylinder are replaced by a separate thin plate of metal positioned in an interstice between the fixed and movable cylinders. The plate is anchored against the lock housing by splined means to prevent any rotation of the plate relative to the housing. The fixed cylinder is also anchored by a splined relationship, but the corresponding projections on the fixed cylinder is thinner, permitting a limited degree of play in which the openings in the plate through which the locking pins pass may be disaligned from the corresponding bores in the fixed cylinder. The openings in the plate may be of the same diameter as the bores in the fixed cylinder, since a relative shifting movement is available which is not present in prior art constructions. This fact facilitates assembly of the lock, and enlarges the commercial tolerances under which the lock is made.

BRIEF DESCRIPTION OF THE DRAWING

In the drawing, to which reference will be made in the specification, similar reference characters have been employed to designate corresponding parts throughout the several views.

DETAILED DESCRIPTION OF THE DISCLOSED EMBODIMENT

Figure 1:
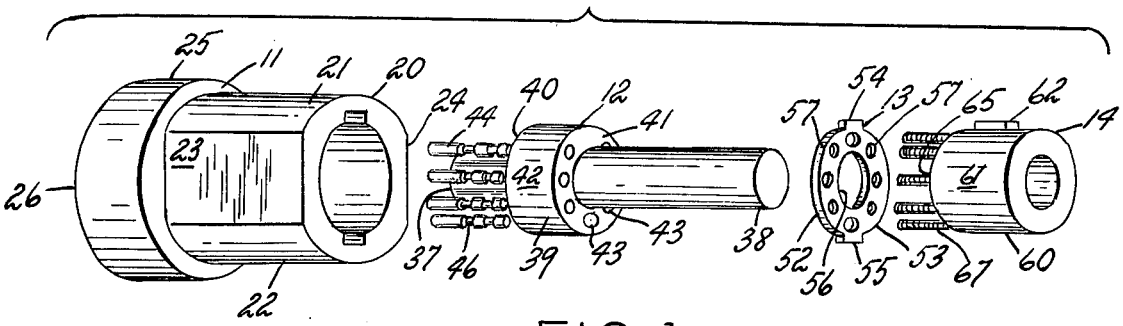
FIG. 1 is an exploded view in perspective of an embodiment of the invention.
Figure 2:
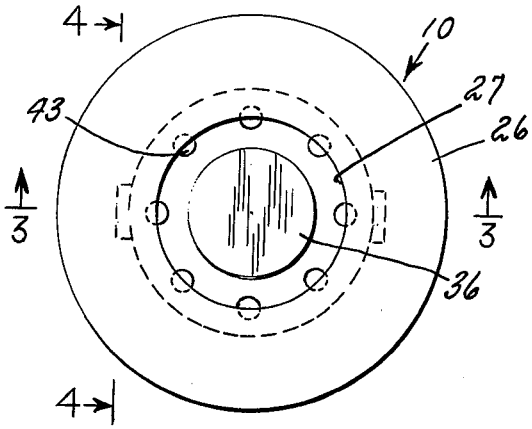
FIG. 2 is a front elevational view thereof.

In accordance with the invention, the device, generally indicated by reference character 10, comprises broadly: an outer housing element 11, a rotating cylinder element 12, a locking plate element 13, and a fixed cylinder element or plug 14.

The housing element 11 is of generally conventional congfiguration, including an elongated main body 20 bounded by a pair of outer curved surfaces 21 and 22, and a pair of planar surfaces 23 and 24 to define a noncircular cross section preventing rotation of the housing relative to a door or other structure in which it is installed. A forwardly positioned cylindrical outer member 25 is bounded by a forward surface 26 having a centrally disposed opening 27 for the insertion of a key (not shown). The body 20 defines a cylindrical bore 30 extending from an outer end 32 to an inner end 32, and a pair of oppositely disposed co-extensive rectangular grooves 33 and 34.

The rotating cylinder element 13 includes an elongated shaft member 36, a front end 37 of which serves as a key stop, and a rearward end 38 which mounts latch operating means of conventional type (not shown). Surrounding the shaft member 36 is a pin retaining member 39 bounded by a forward surface 40, a rearward surface 41 and a cylindrical surface 42, the diameter of which corresponds to that of the bore 30. A plurality of peripherally arranged bores 43 accommodate the split pins 44 which form the tumblers of the lock, the same including annular recesses 46 disposed at periodic intervals.

The locking plate element 13 is preferably formed as a stamping, and may be tempered if required. It is bounded by first and second planar surfaces 50 and 51, repectively, annular edge portions 52 and 53, and first and second radially extending projections 54 and 55, corresponding in configuration to the cross section of the grooves 33 and 34. A centrally disposed bore 56 engages the shaft member 36, and a plurality of peripherally located circular bores 57 correspond in placement to the bores 43.

The fixed cylinder element or plug 14 includes a cylindrial main body 60 bounded by an outer surface 61 from which an elongated projection 62 radially projects. The projection 62 is bounded by side surfaces 63 and 64 spaced from each other a distance substantially less than the width of the grooves 33 and 34, so that when the projection engages one of said grooves, a limited degree of axial rotational play is possible. The body 60 includes a forward surface 65 from which a plurality of blind bores 66 extend, the bores accommodating spring 67 and portions of the split pins 44 in well known manner.

Figure 4:
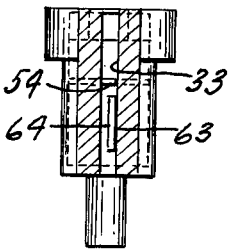
FIG. 4 is a longitudinal sectional view thereof as seen from the plane 4—4 in FIG. 2.
Figure 3:
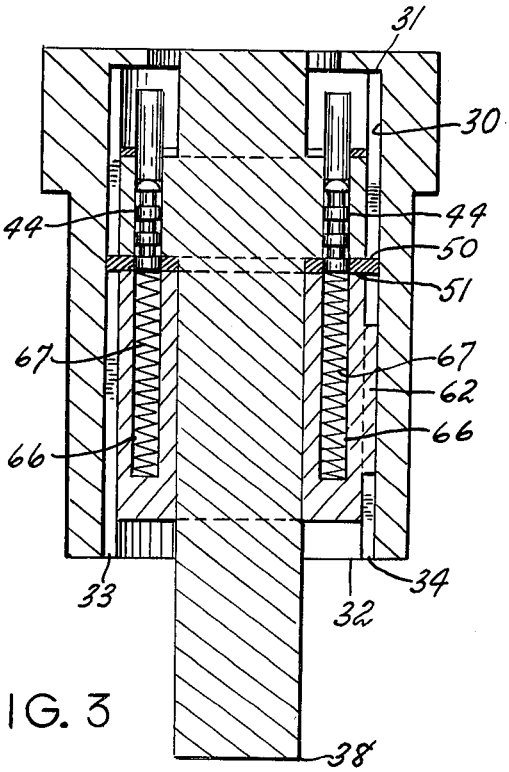
FIG. 3 is a central longitudinal sectional view thereof as seen from the plane 3—3 in FIG. 2.

From a consideration of FIGS. 3 and 4, it will be apparent that when an attempt is made to pick the lock, the usual initial torquing applied to the rotating cylinder element 12 will cause rotational movement to be transmitted through the pins 44 to the relatively fixed cylinder element 14. A limited degree of rotation will result, during which time the projection 62 moves from the right hand surface of the groove (FIG. 4) to the left hand surface thereof, the groove, being engaged with the projection 54 preventing any movement of the plate element 13. When this occurs, the edges of the peripheral bores 57 will become disaligned from the corresponding edges of the bores 66 in the body 60, and will enter at least some of the annular recesses 45 in the pins to prevent any further axial movement thereof. This locking action effectively frustrates further picking operations, and remains in effect until the lock is returned to its initial condition.

I wish it to be understood that I do not consider the invention limited to the precise details of structure shown and set forth in this specification, for obvious modifications will occur to those skilled in the art to which the invention pertains.

I claim:

1. In a multiple axial pin tumbler lock including an outer housing element adapted to be engaged in non-rotational relation relative to a supporting structure, a rotating cylinder element including a rearwardly projecting shaft for actuating a latch, a relatively fixed cylinder element axially aligned with said rotating cylinder element, and a plurality of split pin tumblers engaging bores in said rotating and relatively fixed cylinder elements to immobilize said rotating cylinder element, said pins defining a parting line which is aligned with an edge of said rotating cylinder upon insertion of a key engaging the outer ends of said pins, the improvement comprising: a thin plate having first and second planar surfaces abutting a planar surface of each of said rotating and fixed cylinder elements, said plate having peripherally disposed bores permitting the passage of pin tumblers therethrough and means preventing axial rotation of said plate relative to said housing element; said pin tumblers having annular recesses along the length thereof, said relatively fixed cylinder element being positioned in said housing element and having means permitting limited axial rotation of said relatively fixed cylinder element relative to said housing element; whereby upon an attempt to pick said lock by exerting a torque upon said rotating cylinder element in the absence of a proper key, said rotating and relatively fixed cylinder elements will execute limited rotation relative to said plate, resulting in disalignment of the peripherally disposed bores thereof with respect to corresponding bores in said fixed cylinder element, the edges of said bores in said plate engaged at least some of the annular recesses in said pins to prevent axial movement thereof.

2. Structure in accordance with claim 1, further characterized in said housing element having a centrally disposed bore accommodating said rotating and relatively fixed cylinder elements and said plate therebetween, there being at least one elongated axially oriented groove bordering said centrally disposed bore, said plate having a projection of effective width corresponding to the width of said groove, and engaged therewith, said relatively fixed cylinder element having a corresponding projection of lesser width than that of said groove and being engaged therewith to permit said limited rotation.

* * * * *